US009180948B2

(12) United States Patent
Prade

(10) Patent No.: US 9,180,948 B2
(45) Date of Patent: Nov. 10, 2015

(54) PADDLE DEVICE AND WATER VEHICLE

(76) Inventor: Ernstfried Prade, Kinsau (DE)

( * ) Notice: Subject to any disclaimer, the term of this patent is extended or adjusted under 35 U.S.C. 154(b) by 0 days.

(21) Appl. No.: 14/236,937

(22) PCT Filed: Aug. 6, 2012

(86) PCT No.: PCT/EP2012/065361
§ 371 (c)(1),
(2), (4) Date: Feb. 4, 2014

(87) PCT Pub. No.: WO2013/020952
PCT Pub. Date: Feb. 14, 2013

(65) Prior Publication Data

US 2014/0187108 A1 Jul. 3, 2014

(30) Foreign Application Priority Data

Aug. 5, 2011 (DE) ..... 10 2011 109 651
Jul. 23, 2012 (DE) ..... 10 2012 106 672

(51) Int. Cl.
*B63H 16/04* (2006.01)
*B63H 16/06* (2006.01)
*B63B 35/79* (2006.01)
*B63B 35/71* (2006.01)

(52) U.S. Cl.
CPC ..... *B63H 16/04* (2013.01); *B63H 16/06* (2013.01); *B63B 35/79* (2013.01); *B63B 2035/715* (2013.01); *B63B 2221/20* (2013.01)

(58) Field of Classification Search
CPC ..... B63H 16/00; B63H 16/04; B63H 16/06
USPC ..... 440/104, 107
See application file for complete search history.

(56) References Cited

U.S. PATENT DOCUMENTS

| | | | | |
|---|---|---|---|---|
| 468,960 | A | 2/1892 | Vondersaar | |
| 2,033,637 | A | 3/1936 | Edmund | |
| 2,083,004 | A | 6/1937 | Haskell | |
| 5,364,296 | A | 11/1994 | Cerny | |
| 5,595,517 | A | 1/1997 | Smith | |
| 6,632,111 | B2 | 10/2003 | Oathout | |
| 6,645,025 | B2 * | 11/2003 | Oathout | 440/104 |
| 6,796,863 | B1 | 9/2004 | Oathout | |
| 7,581,996 | B1 | 9/2009 | Boller | |

FOREIGN PATENT DOCUMENTS

| | | | |
|---|---|---|---|
| CA | 1288009 | C | 8/1991 |
| DE | 572423 | C | 3/1933 |
| DE | 20002806 | U1 | 7/2000 |

* cited by examiner

*Primary Examiner* — Lars A Olson
(74) *Attorney, Agent, or Firm* — David A. Guerra

(57) ABSTRACT

The invention relates to a paddle device (10) for water vehicles, wherein a double or single paddle (2) is attached to a height-adjustable spar (1) so as to be movable in all directions, and the spar can be movably and detachably connected to the floating body (6) of a water vehicle, wherein the paddle device has a device (14, 16) for fixing the spar (1) in the direction of the bow and/or stern of the water vehicle; the paddle device (10) is used for force-saving paddling together with improved propulsion.

16 Claims, 7 Drawing Sheets

PADDLE DEVICE AND WATER VEHICLE

CROSS-REFERENCE TO RELATED APPLICATIONS

This application is an U.S. national phase application under 35 U.S.C. §371 based upon co-pending International Application No. PCT/EP2012/065361 filed on Aug. 6, 2012. Additionally, this U.S. national phase application claims the benefit of priority of co-pending International Application No. PCT/EP2012/065361 filed on Aug. 6, 2012, German Application No. 10 2011 109 651.9 filed on Aug. 5, 2011 and German Application No. 10 2012 106 672.8 filed on Jul. 23, 2012. The entire disclosures of the prior applications are incorporated herein by reference. The international application was published on Feb. 14, 2013 under Publication No. WO 2013/020952 A1.

BACKGROUND OF THE INVENTION

1. Field of the Invention

The present invention relates to a paddle device for water vehicles according to the generic clause of patent claim 1 and to a water vehicle including such paddle device. 2. Description of the Prior Art It is generally known to propel a water vehicle forward by means of a single blade or double blade paddle. A whole series of inventions have made it their object to improve this most simple form of paddling. Devices are known for water vehicles, by means of which the user, in a seated position, besides the conventional single blade paddle (also known as spade paddle) also uses double blade paddles in a holding device by means of which the paddle is suspended, such that the weight of the paddle need not be carried continuously by the user. In the case of Canadian Application CA 1,288,009, the inventive concept consists in that the paddle is suspended from a boom which is fitted pivotally revolvable about a mast, mounted on a floating body.

According to the subject of U.S. Pat. No. 7,581,996 B1 the object is pursued to create a kind of "third hand". In this case, the single blade paddle is connected at its end where the grip is situated to the floating body by a device, such that, for example, a left-hand and a right-hand single blade paddle, instead of with both hands, need only be held and operated with one hand. The paddles are linked to a support, which, in turn, is linked close to the bow of the floating body. The user grips with the one hand the left-hand paddle and with the other hand the right-hand paddle.

In DE 200 02 806 U1, a double blade paddle is described, which is suspended from a boom in fixed relationship to a floating body. According to U.S. Pat. No. 5,364,296, the user operates a kind of U-beam, to the end of which a paddle is fitted. This U-beam is fitted by means of two solid stationary supports to the floating body, the forward propulsion is attained in that both paddles are moved forward and backward. In both those applications U.S. Pat. No. 6,632,111 B2 and U.S. Pat. No. 6,796,863 B1 the teaching concerns a double bladed paddle to be fitted movably to a movable support. The support serves for weight reduction of the double bladed paddle. It is level adjustable and fitted by way of a variety of fitting options such as straps and fixed brackets to the floating body. In essence, the paddle suspensions only serve the purpose to reduce the weight of the paddle that has to be carried by the user.

If a single blade or double blade paddle is suspended by a kind of boom by way of one or two fixing ropes, as described in DE 200 02 806 U1, this results in the user being highly restricted in his use of the paddle. The pattern of movement of a single or double blade paddle resides in that the user immerses the paddle with both hands close to the bow and guides it laterally by means of a more or less intensive pulling action (and terminating in a thrust move) out of the water again at the stern.

In performing this, the centre of the paddle does not remain in the centre of the axis of elongation of the boat, but is moved outwardly towards the one or other side. Furthermore, there results a forward-backward as well as an up- and down movement of the paddle centre point. In a working example of the aforesaid DE 200 02 806 U1, this is taken into account in that the paddle is suspended from a flexible cord. This, however, takes into account only inadequately the circumstances of drift by the centre point of the paddle. For example, if the paddle is moved very far outwardly and towards the rear, a more or less intense tensile force is applied to the flexible cord which the user must counteract with each paddle thrust. This means that the concept of weight reduction of the paddle is partly neutralized in that the user, in the case of this invention, must apply an additional force in the lateral and downward movement as compared with a conventional paddle, in order to counteract the resilient traction of the cord to which the paddle is fitted.

If the elastic cord for the suspension of the paddle is too resilient, it will not contribute to the weight reduction of the paddle. If it is rather non-resilient, each paddle movement results in an undesirable heeling of the floating body.

All aforesaid paddle devices have in common that, when used in accordance with the respective invention, they can only be handled while seated and strongly impair the function of the single and double blade paddle. The suspensions and fixation constructions to which the paddles are fitted and which serve for the weight reduction of the paddle are cumbersome and impracticable. A typical paddle boat, canoe or surfboard, having a fixed boom fitted in front of or behind the user to the water vehicle lends an un-sporty appearance to the water vehicle, as well as a distinctive technical restriction to the use of the suspended paddle as compared with the use of conventional single blade or double blade paddles.

SUMMARY OF THE INVENTION

The embodiment according to the invention of a paddle device serves to overcome the aforesaid shortcomings and to provide a paddle device and a water vehicle including such device, permitting effort saving paddling when seated or standing, wherein the typical pattern of movement of a single blade or double blade paddle operation is not impaired.

This object is attained by a paddle device having the features of patent claim 1, respectively a water vehicle incorporating it.

Advantageous further developments form the subject of the subsidiary claims.

In accordance with the invention, the paddle device includes a single blade or double blade paddle which is linked movably and releasably to a level adjustable spar. The latter is movably and releasably connected to a floating body. According to the invention, provision is made that the spar is fixed by means of a device approximately in the central plane of the boat, i.e. in longitudinal direction of the water vehicle, at least in one direction, i.e. towards the bow or towards the stern, such that the pivotability of the spar in that direction is limited, but remains possible in the remaining directions.

It is particularly preferred if this device limits the movability of the spar in the direction of the stern, i.e. in the direction towards the paddler.

By virtue of the construction according to the invention and the fixing of the spar in a direction of movement, the effort to be exerted by the paddler as compared with a free support, that is to say the support according to the state of the art in which clearly more degrees of freedom are provided for, have been clearly increased. That is to say, for a given exertion of force it is possible to attain clearly higher travel velocities.

The water vehicle equipped with such a paddle device may, for example, be a paddle boat or a SUP [stand-up paddle boat].

In accordance with an advantageous embodiment of the paddle device, the spar is connected, preferably releasably, to the paddle by way of a first linkage. The paddle device is provided with a further articulation means, by way of which the spar is fitted to the water vehicle, for example a paddle boat or the SUP.

The adaptation to the paddling person is particularly simple if the spar is of level adjustable design and/or the linkage is mounted on a rail in fixed relationship to the water vehicle in a manner permitting adjusting the spar and thereby providing an adaptation to the paddling person in the vehicle longitudinal direction.

The propulsion can be further improved if the spar and/or the paddle is of arcuate design.

In an embodiment of particularly simple design, the device for limiting the freedom of movement of the spar is provided by a guy rope or the like which, at one end, engages the spar and at the other end is fixed in relation to the water vehicle such that, when traction is applied to the guy rope, the spar is blocked in the direction of traction, thus making it possible for the paddler to support himself in the afore described manner. In this context, it is preferred if the effective length of the device for example if the guy rope is adjustable. This adjustment may for example be performed by means of a clamp, a block and tackle or the like. It stands to reason that, as an alternative of a guy rope, other tension resisting means can be used, which permit an articulation of the spar in the remaining directions.

According to one embodiment, the articulation means is provided by way of a linkage including a base plate fitted to a water vehicle and connected pivotally to a linkage base, the spar being supported by the linkage base.

With such an embodiment, it may be advantageous if the spar, in turn, is fitted to the linkage base by means of a pivot linkage, the axis of articulation of the pivoting linkage being positioned approximately parallel to the central axis of the boat or in the central axis of the boat, and the pivoting axis of the linkage extending between the base plate and the linkage base in transverse relationship to the latter.

The utility of such an articulation means is further improved if the linkage base and the base plate are mutually positionally fixable by way of a locking device, such that pivoting about the aforesaid linkage is no longer possible.

In principle, it is also possible to provide, instead of a single guy rope for tractional support of the spar, a further guy rope or the like in the opposite direction, such that the spar is only pivotal transversely to the plane embraced by the guy ropes.

The device is rendered particularly compact if the spacing between the foot point of the spar and the fixation of the guy rope or the like to the water vehicle is in the range of between 10 and 30 cm, preferably in the range of 15 cm.

Accordingly, the objects of the present invention are attained particularly by a level adjustable spar, to the upper end of which a single blade or double blade paddle is fitted in an all round pivotal manner. In this context, the spar has the object of carrying the paddle, such that it has no weight, the effort to be extended for paddling is reduced and, when used in accordance with the invention, the propulsion of the water vehicle is decidedly improved.

The pivoting of the spar in the direction towards the bow and/or the stern or/and in transverse direction, that is to say in relation transversely to the longitudinal axis of the water vehicle, may be limited by way of suitable means, for example, a stop member. This limitation effective in the lateral or longitudinal direction of the water vehicle takes care of an additional support for the paddle.

In an embodiment of the invention, provision may be made for the means for fixing the spar to be performed with a degree of resiliency such that, in the event of unskilled use with excessive force application, the components of the paddle device or the deck of the water vehicle cannot be damaged.

For the sake of completeness, it may once again be emphasized that the means for fixing the spar are so designed as to permit a certain pivotibility of the spar in the aforesaid directions, whereafter, after the device becomes effective, for example tension being applied to a guy rope, a support of the spar is made possible in order to improve the transmission of force.

BRIEF DESCRIPTION OF THE DRAWINGS

Advantageous embodiments of the invention will be further elucidated in what follows with reference to schematic drawings. There is shown in.

DETAILED DESCRIPTION OF THE INVENTION

Figure 1:
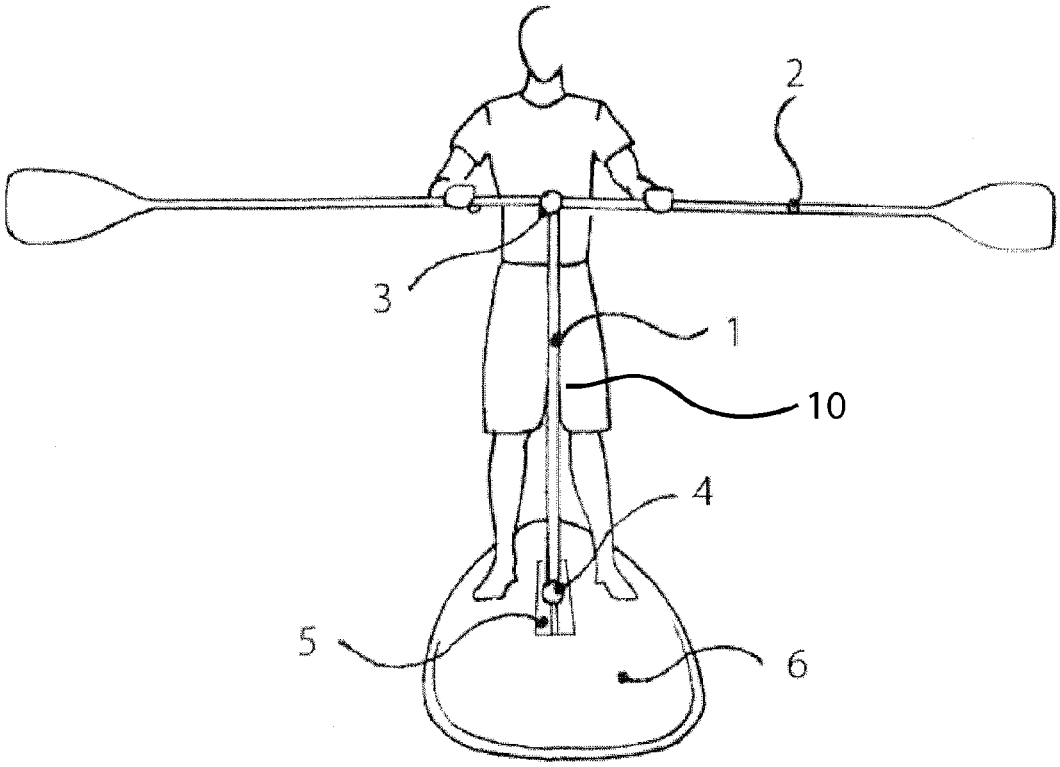
FIG. 1 a projection of a water vehicle in accordance with the invention including a paddle device in a position of rest, FIG. 2 a projection of the paddle device in use, FIG. 3 an aspect of the paddle device in the first one third of the paddle movement, FIG. 4 an aspect of the termination of the paddle movement, FIG. 5 an aspect of the paddle device with additional functionality, guy ropes between the spar and the water vehicle, FIG. 6 a partial view of a paddle device, the pivotibility of which is limited by a device and FIG. 7 an embodiment of an articulation means of the paddle device according to FIG. 1, FIGS. 8*a*, 8*b* projections of a paddle boat including paddle devices according to the invention, FIGS. 9*a*, 9*b* detailed views of paddle devices according to FIG. 8, FIG. 10 a single view of a working example of a linkage for fitting a double blade paddle and FIG. 11 a sectional view of a further working example of a paddle device.

FIG. 1 represents a working example in which the water vehicle has been designed as an SUP which, normally, takes the form of a board 6 on which the paddle device according to the invention is provided. This paddle device 10, in the embodiment illustrated, incorporates a double blade paddle 2. It stands to reason that, instead of such a double blade paddle, it is also possible to use a single blade paddle. In the illustrated working example, the paddle device 10 includes a spar 1 which carries the paddle 2 and is connected to the latter at its upper end facing the paddle by way of a linkage 3. This linkage 3 is preferably so designed that the paddle 2 is fitted in a manner pivotal virtually in all directions, excluding of course the collision regions with the spar 1.

At its lower end adjoining the board, the spar is fitted to the floating body 6 by an all round pivotal articulation means 4, in which context a rail 5 may also be used, on which the position of the spar 1 can be shifted along the centre plane of the boat. Such a rail 5 is provided conventionally on SUPs in order to fit a surf rig or the like. It stands to reason that conventional surf boards having adequate buoyancy may also be constructed with the described paddle device 10. Such surf boards are in most cases equipped with a rail 5.

The single or double blade paddle 2 resting on the spar 1 becomes virtually weightless during the paddling procedure. A single blade paddle fitted to the spar 1 also virtually loses its weight. The spar 1 consists preferably of telescope tubings, by means of which the fitted single blade or double blade paddle 2 can be used at the level adapted to the body in a seated or standing position.

The use of a single blade or double blade paddle 2 on the spar 1 makes it possible for the user in a standing position to maintain the dynamic equilibrium on narrow water vehicles such as, e.g. surf boards. During paddling as well, the user, due to the mass of the paddle fitted to the spar 1, can continually maintain the equilibrium which results in a relaxed way of standing on the narrow water vehicle.

For keeping the balance, it is in this context of great importance that, between the single blade and double blade paddle 2, the spar 1 is fitted by means of a virtually all round pivotal linkage 3 above and by a virtually all round pivotal articulation means 4 below, that is to say, adjoining the board. Any fixed connection would cancel the balancing ability. This may best be demonstrated by the example of the balancing performance of a wire rope walker. His balancing rod, by means of which he maintains his dynamic equilibrium were it to be fixed to the wire rope, the rod would be useless for maintaining the equilibrium. Accordingly, the spar 1 must be fitted to the floating body movably in all directions laterally. A double bladed paddle 1 due to its all round moveable spar 1, becomes in use a natural balancing rod as also used by wire rope walkers.

Figure 2:
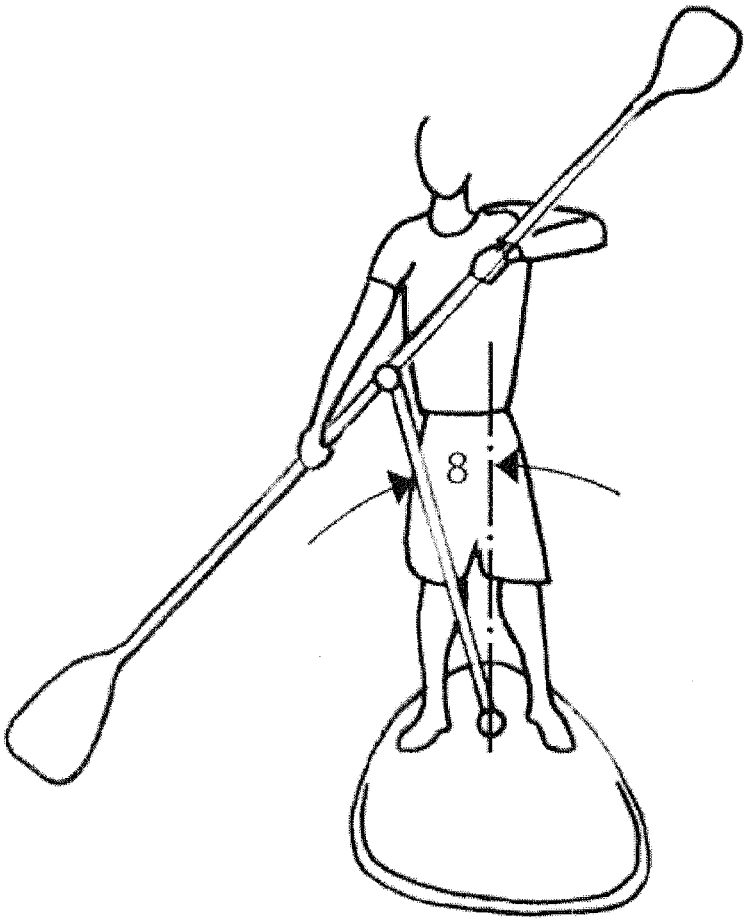

In accordance with FIG. 2, the spar 1 permits also without problems to cause the single or double blade paddle 2 to lean over laterally during the paddling procedure. In doing so, the spar 1, on the paddle immersion side, leans over at a variable angle 8. Since the lower end of the spar remains in the central plane of the boat, even a narrow water vehicle such as e.g. a surf boat, experiences no heeling.

Figure 3:
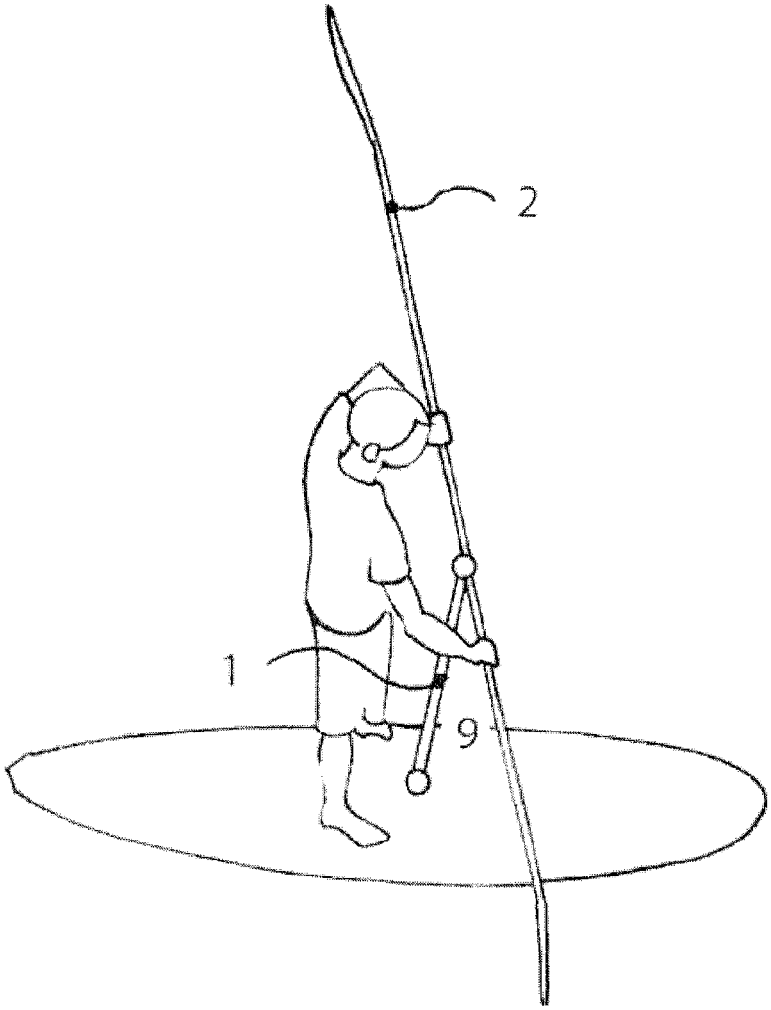
Figure 4:
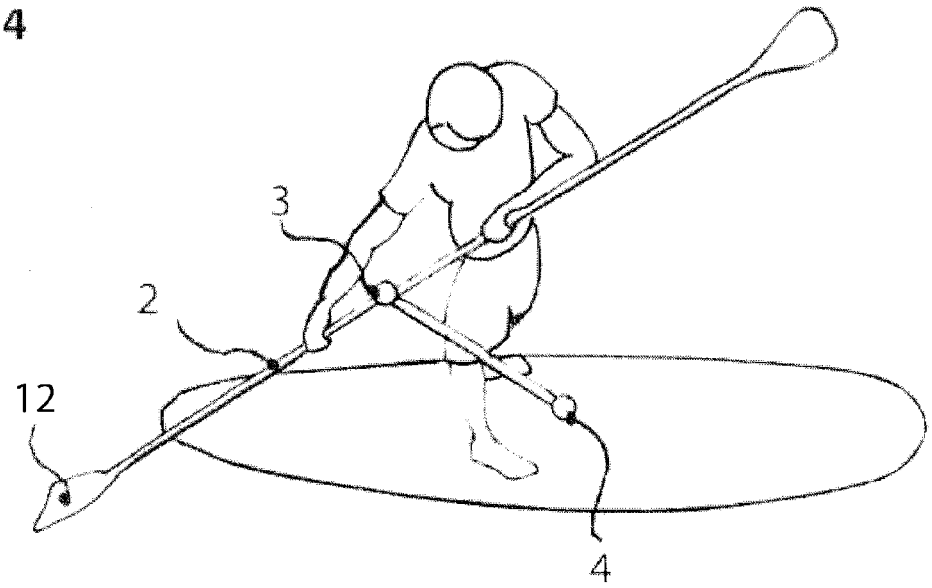
Figure 5:
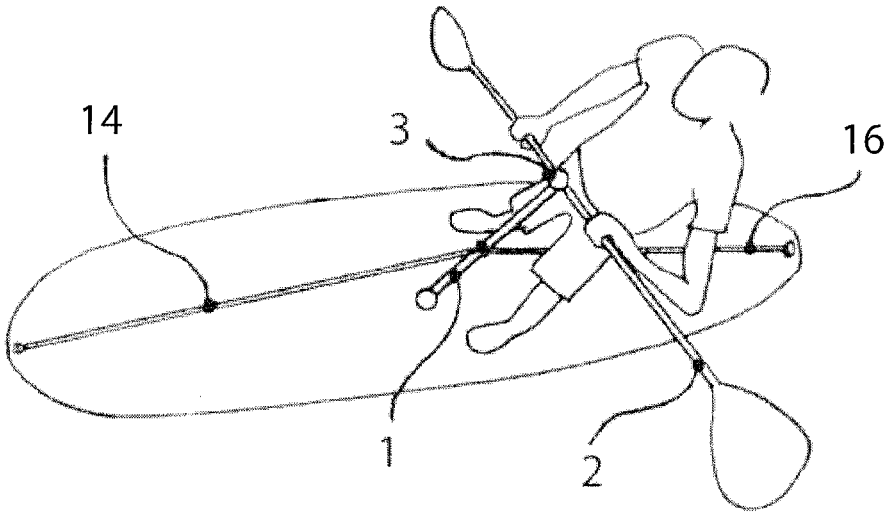

A decisive advantage of the paddle device 10 for the improvement of the forward propulsion is attained by the use of the spar 1. In FIGS. 3 and 4, the paddle device 10 is illustrated while in use. While the paddle 2 is laterally passed from the bow tip (in front) in the direction of the stern (the rear) of the water vehicle, the spar 1 is maintained at an acute angle 9 to the single blade or double blade paddle 1 (see FIG. 3). Approximately as from half way through the paddle procedure, the spar 1 starts to lean towards the back.

If the user now applies a slight pressure from above by his body weight on to the spar 1 and thereby on to the linkage 3, this causes a downward force to be applied to the later, which causes the single blade or double blade paddle 2 to spread out towards the rear as from the virtually all round pivotal articulation means 4.

The downwardly directed overall force acting on linkage 3 thus induces by way of a partial component of force, a movement of the paddle blade 12 in rearwards direction and thereby provides a decisive forward propulsion of the water vehicle.

In the standing position, the paddle device 10 is so adjusted that the linkage 3 is approximately at navel level. In a further embodiment, the telescope-like spar 1 may, by means of a spring element, be so designed that the upper portion can shift by way of the all round pivotal linkage 3 downwardly in the direction of the virtually all round pivotal articulation means 4. The overall height of the spar 1 is shortened thereby during the downward passage and immersion of the paddle and becomes elongated automatically again during the upward move of the paddle. This embodiment of the spar 1 brings about a shortened path of the paddle blade 12 to the water which, in turn, results in that the single or double blade paddle may be constructed shorter.

In a further embodiment, the spar may also be rendered resilient and self-contracting during the paddling procedure by being composed entirely of a spring member such as for example a coil spring which, during the downward passage of the paddle bends and thereafter automatically is straightened again.

Particularly for long distance travel on water, the paddle device 10 is a means which reduces physical exertion. A guy rope 14 restricts the movability of the latter, such that it can only lean forwardly or sideways. The linkage 3 now acts as an oar lock, and the single or double paddle 2 as an oar. The user is thereby enabled to pull through the paddle with the right hand during each paddle stroke and to apply the advantages of an oar lock-oar rowing device.

A guy rope 16 strung from the stern to the spar 1 inhibits the latter in its forward movability, such that the left hand gains the benefit of an oar lock-oar rowing device. In this case, the left hand is enabled to push the single blade or double blade paddle 2 forwardly with full force.

If the guy ropes 14 and guy ropes 16 are tightened simultaneously, this embodiment extols its full effect for long distance travel. The linkage 3 serves as an oar lock both for the right as well as the left hand, such that both hands and arms, when applying full power, attain a maximum forward propulsion. The forward and backward restriction of movement of the spar 1 may also be attained by other design solutions, such as for example, simple locking pins directly on the linkage, which prevent forward or backward leaning of the spar. The important balancing feature of the single blade or double blade paddle 2 in sideways direction is left fully maintained, even by the inhibition of movement of the spar 1 in forward and rearwards direction.

In the previously elucidated working example, the guy ropes 14, 16 extend from the spar 1 to the bow or stern of the water vehicle, in the present case the SUP.

Figure 6:
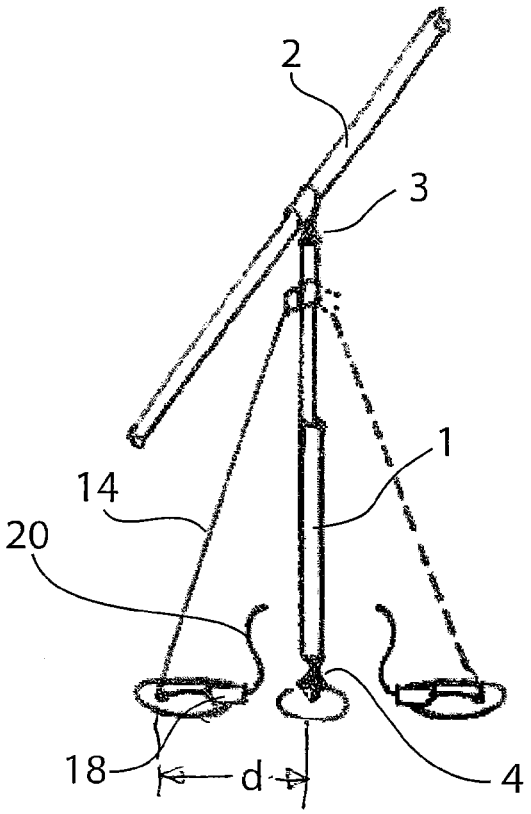

FIG. 6 shows a modification in which only the guy rope 14, in the direction towards the bow, is provided, yet not extending all the way to the bow, but merely being fixed to the deck of the water vehicle at a distance from the mounting point of the spar 1. In a preferred embodiment, this distance amounts to approximately 10 to 30 cm, particularly preferred is a distance of approximately 15 cm. The length of the guy rope 14 may be adjustable for purposes of the basic setting of the spar inclination. A clamp 18 is indicated in FIG. 6, by means of which the terminal section 20 of the guy rope can be fixed adjustably. This clamp 18 is likewise fitted to the deck of the water vehicle. As indicated in FIG. 1, the guy rope 16, extending in the direction of the bow, may likewise be also designed longitudinally adjustable, such that the support distance is likewise comparatively short and is not designed to extend over the entire distance from the stern. It stands to reason that, as explained, instead of the guy ropes 14, 16, other tension-resistant means may be employed, which are equivalent in function to that of the guy rope.

In the illustrated working examples, rubber-like elastic linkages, articulation means 3, 4 are provided for fitting the double blade paddle 2 to the spar 1 or the spar 1 to the water vehicle (SUP) 6. Such rubber linkages are used, for example, for mast base joints of a wind surfer board, so that reference may be made to their respective technology and selection of material.

Figure 7:
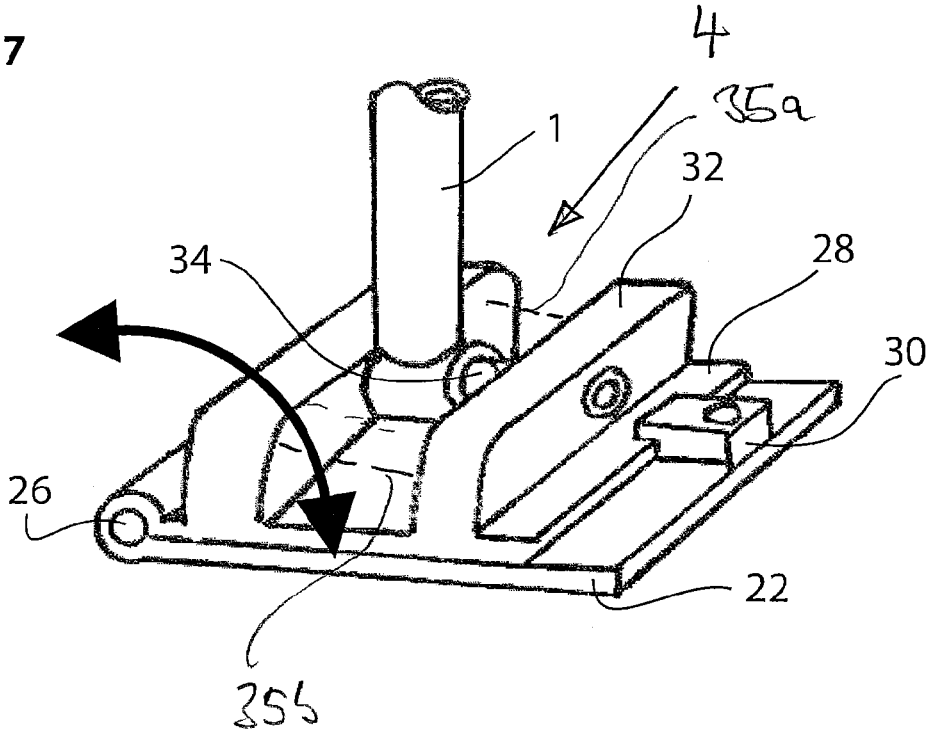

FIG. 7 shows an embodiment of an articulation device 4, as may be used, for example, for a paddle boat. Such a paddle boat, including the paddle device 10, fitted in accordance with the invention, is illustrated by way of example in FIG. 8. As elucidated, the paddle device 10 is supported at the bottom 36 of the paddle boat which, for the sake of simplicity, is likewise denoted by the reference symbol 6. In the illustrated working example, the paddle boat takes the form of a two-seater, so that correspondingly for each paddler, a paddle device 10*a*, 10*b* is provided.

The articulation means 4 includes a base plate 22 which is fixed for example by a velcro fastener or by clamping to the bottom of the water vehicle, preferably of the paddle boat 24. This base plate 22 is connected by way of a linkage 26 to a pivoting panel 28. This linkage 26 accordingly permits pivoting of the linkage panel 28 in the direction of the arrow in relating to the base plate 22. The axis of the linkage 26 is provided transversely to the longitudinal axis of the boat, such that the linkage 26 is directed towards the bow in such a manner that the pivoting panel 28 is rendered pivotal towards the bow.

In the opposite direction, i.e. towards the stern, the pivoting panel 28 comes to rest on the base plate 22. This relative pivoting can be cancelled by way of an indicated locking device 30, such that the pivoting plate 28 is positionally fixed to the base plate 22. In the illustrated embodiment, the locking device 30 takes the form of a rotary toggle which, from the illustrated latching position, is pivotal into a release position. On the pivoting plate 28 a bracket 32 is fitted, which carries a pivoting linkage 34, by way of which the spar 1 is connected pivotally to the pivoting plate 28, the axle of the pivoting linkage 34 extending approximately in the longitudinal direction of the boat and accordingly transversely to the axis of the linkage 26. Correspondingly, the spar 1 can be pivoted about the pivoting linkage 34, transversely to the longitudinal axis. By such an articulation means 4, similarly to the very simple guy rope 14, the pivotability towards the rear is thus limited by coming to rest on the pivoting plate 28 on the base plate 22; in the remaining pivoting directions, the spar 1 can be pivoted in the afore described manner in order to convert the force exerted by the paddling person with a high degree of efficiency into forward propulsion. The solution illustrated in FIG. 7 is suitable as aforesaid, particularly for employment in boats such as, for example, paddle boats, canoes, kayaks and the like.

As explained further above, the articulation means may be so designed that they permit pivoting of the spar 1 only within a predetermined angular range in relation to the water vehicle longitudinal axis and transversely thereto and prevent any pivoting beyond that. Thus, there may for example be fitted to the bracket 32, as indicated in FIG. 7, stop members 35*a*, 35*b*, which restrict the lateral pivoting of the spar 1, thereby permitting the paddler on attainment of the contact position to find support against the stop member, such that the transmission of forces is further optimized. Such stop members may obviously be provided with all afore described working examples.

Figure 8:
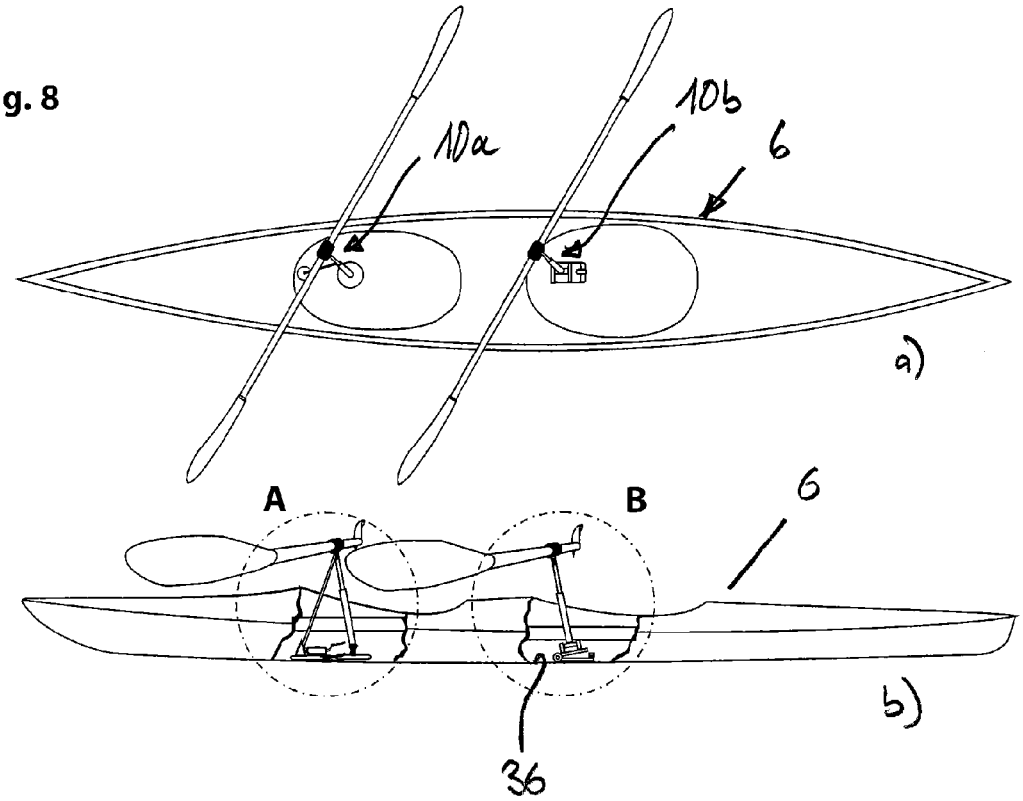

In FIG. 8, two different paddle devices 10*a*, 10*b* are illustrated. The paddle device 10*a* which, in this illustration, is on the bow side and on the left-hand side, is of similar design to that shown in the embodiment of FIG. 6, whereas the paddle device 10*b* on the stern side is constructed according to the working example illustrated in FIG. 7.

Figure 9:
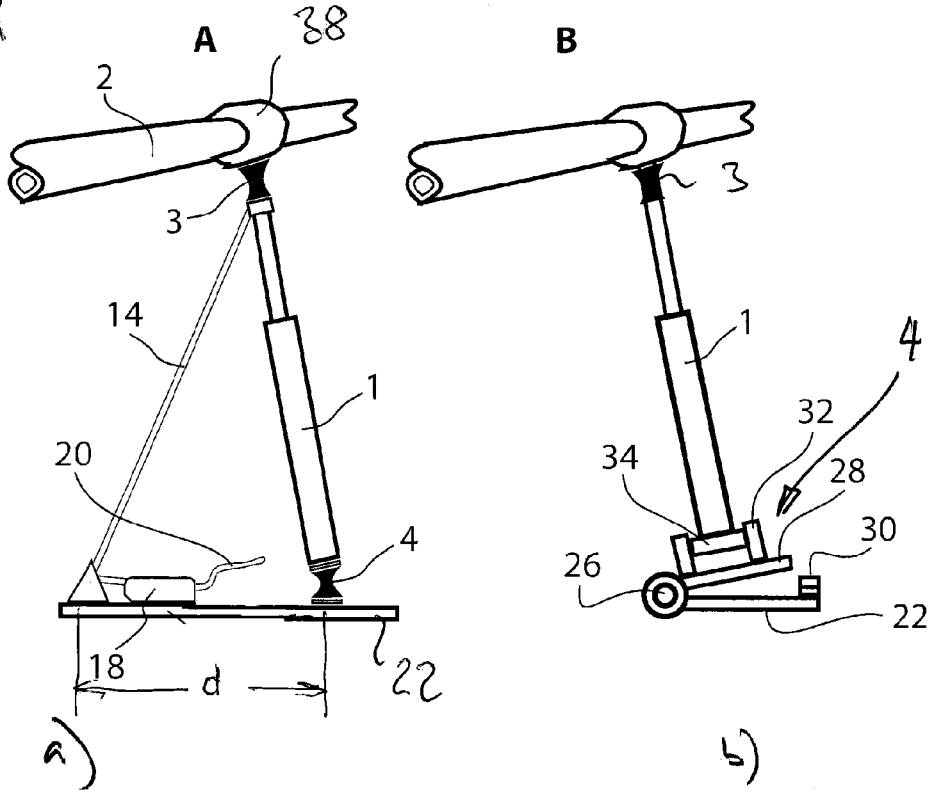

FIG. 9*a* shows once again a detailed view of the paddle device 10*a* for the paddle boat in FIG. 8. Similar to the working example according to FIG. 6, the spar 1 is designed telescopically longitudinally adjustable and connected by way of a rubber-like elastic linkage 3 to the double blade paddle 2. On the base side, the fixation is performed by way of the likewise rubber-like elastic articulation means 4 which, similarly to the working example according to FIG. 7, is fitted on a base plate 22, which is, for example, pushed under the seat of the paddle boat. Also on this base plate 22, there is likewise provided the clamp 18 for adjusting the guy rope 14. The guy rope 14 may also be fixed by way of a carbine clip or the like to the base plate 22. In the illustrated working example, the linkage 3 is equipped with a sleeve 38, which is releasably connected to the double blade paddle 2. I.e., this sleeve 38 may, for example, be clamped to the double blade paddle 2 or be positionally fixed by way of spring pins.

The paddle device 10*b* on the stern side in accordance with FIG. 9*b* is constructed similarly to the working example in FIG. 7. In accordance therewith, the articulation means 4 is made to include the base plate 22 fixed to the bottom 36 and the pivoting plate 28 in pivotal relationship to the former, the latter once again carrying the bracket 32 with the pivoting linkage 34, which permits pivoting the spar 1 normal to the plane of the drawing in FIG. 9*b*. In this case as well, the spar 1 is of telescope construction and bears on the paddle side the linkage 3, which is constructed according to the working example in FIG. 9*a*.

As explained, instead of a telescopically adjustable spar 1, it is also possible to employ a construction, in which the longitudinal adjustment is brought about by plug-together units or the like. Equivalent constructions are used for example for divisible surf board masts or the like.

The base plates 22 are preferably so designed that they can be fixed in a simple manner in the paddle boat 6 or to the SUP or any other floating body, thereby permitting a simple assembly/dismantling on site.

In a working example of simple construction, the telescopic adjustment takes place by way of clamping or spring loaded pins, engaging into a series of perforations. Such constructions are known for example from length-adjustable fork beams. In order to minimize storage space, provision is made for the linking of the linkages to the spar 1 and to the paddle to be fitted releasably, so that the paddle device can be dismantled in a simple manner and requires only little storage space.

Figure 10:
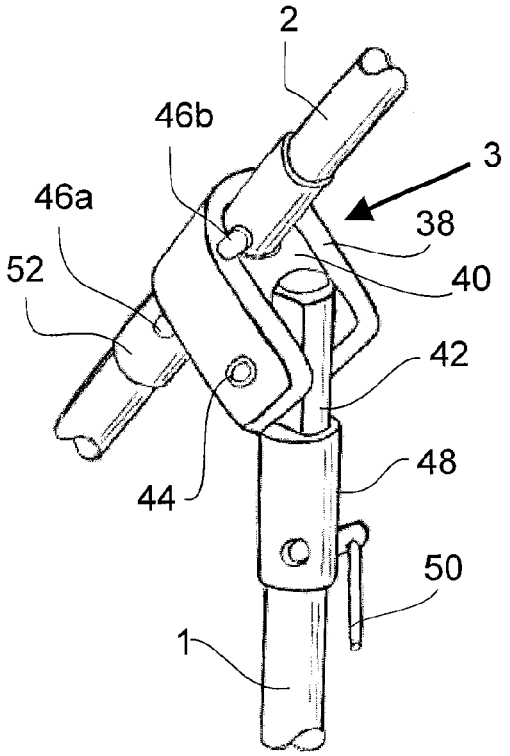

In FIG. 10, a modification is illustrated, in which the linkage 3 is so designed that the double blade paddle 2 is pivotal only transversely to the central axis of the boat. For that purpose the sleeve 38 is provided with a slot 40, into which is inserted a dihedron 42 of the spar 1. An axle 44 then connects the sleeve 38 to the dihedron 42. Due to the planar surface contact of the side surfaces of the slot 40 and the parallel surfaces of the dihedron 42, a very accurate inter engagement is provided. In this illustration, two spring-loaded pins 46*a*, 46*b*, are also clearly visible, by way of which the linkage 3 is fixed to the double blade paddle 2. The dihedron 42 is formed on a linkage socket 48 which, by way of a pin or a screw 50, is fixed to the spar 1, such that the screw 50 tangentially enters into an annular groove of a linkage pin. In the vicinity of the two spring-loaded pins 46*a*, 46*b*, there is further provided a support sleeve 52 which embraces a section of the double blade paddle 2.

Figure 11:
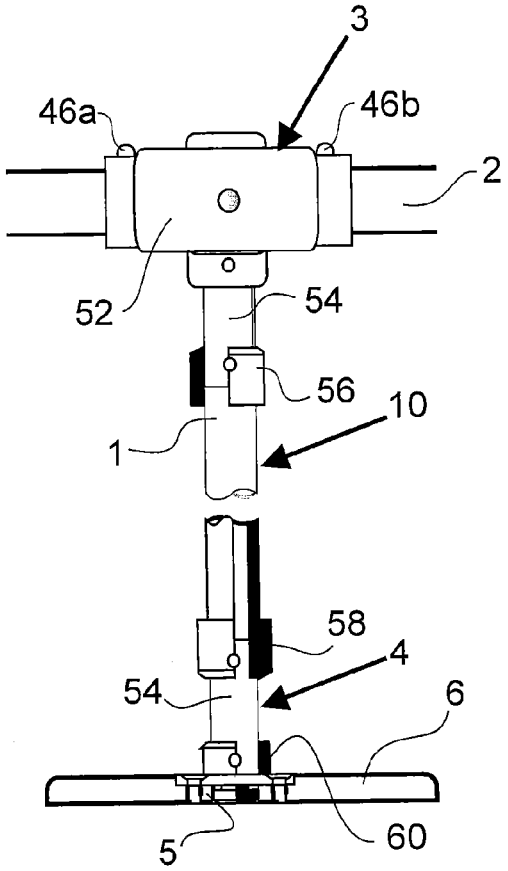

FIG. 11 shows a diagrammatic sectional representation of a further working example of a paddle device 10 wherein, in the above described manner, the double blade paddle 2 is fitted to the spar 1 by way of the linkage 3. The linkage 3, in turn, is fixed to the double blade paddle 2 by way of a support sleeve 52 and spring loaded pins 46*a*, 46*b* and includes a rubber-like elastic linkage member 54 which, by way of a clamping or fixation sleeve 56, is connected to the spar 1. In analogous manner in this working example, the articulation means 4 as well, is in rubber-like elastic manner constructed by means of a linkage member 54 which, on the one side, is connected by way of a clamping or fixation sleeve 58 and, on the other side, by way of a linkage base 60 to the rail 5 of the water vehicle, for example an SUP. In principle, the linkage base 60 may, of course, also, similarly to the above described embodiments, be fitted to a base plate 22 which then, in turn, is releasably or permanently fitted to the water vehicle.

The limitation of the direction of movement of the spar takes place in the above described working examples by way of a guy rope 16 or the face-to-face fixation of the pivoting plate 28 on the base plate 22. Since, by way of this support, enormous forces can be transmitted to the paddle device and be transferred to the deck of the water vehicle, this support may also be established in a resilient manner. Thus, for example, the guy ropes 14, 16 may be provided with a certain flexibility which dampens excessive impact-like loads in case of unskilled handling. Likewise, it is also possible for the articulation means to be produced with some elasticity, so that no rigid power transfer takes place.

In order to minimize the weight, the structural elements may be produced of plastics, for example of fibre re-enforced plastics (carbon etc).

The invention relates to a paddle device for water vehicles, in which a double blade paddle or even a single blade paddle (spade paddle) is fitted on a level adjustable spar in all round movable manner. The spar permits paddling with reduced power exertion combined with improved forward propulsion.

LIST OF REFERENCE NUMBERS

1 spar
2 double blade paddle
3 linkage
4 articulation means
5 rail
6 SUP (stand-up paddle boat), floating body
8 angle
9 angle
10 paddle device
12 paddle blade
14 guy rope
16 guy rope
18 clamp
20 terminal region
22 base plate
26 linkage
28 linkage plate
30 locking device
32 bracket
34 pivoting linkage
35 stop member
36 bottom
38 sleeve
40 slot
42 dihedron
44 axle
46 spring loaded pin
48 linkage head
50 locking screw/pin
52 support sleeve
54 linkage member
56 clamping sleeve
58 clamping sleeve
60 linkage base

The invention claimed is:

1. A paddle device for a water vehicle on which a user is supported, said paddle device comprising:

a spar movably and releasably connected to a floating body, said spar being height-adjustable;

a means for limiting a pivotability of said spar along a central plane of the floating body or transversely in relation thereto;

at least one paddle that is movably articulated and releasably attachable to said spar; and a means for fixing said spar in a direction selected from the group consisting of a bow, and a stern of the floating body.

2. The paddle device according to claim 1, wherein said spar having a first articulation joint means at a first end portion of said spar, and a second articulation joint means at a second end portion of said spar, said first articulation joint means is detachably connected to said paddle, said second articulation joint means is connected to the floating body.

3. The paddle device according to claim 2, wherein said second articulation joint means is fitted on a rail associated with the floating body, said rail is configured to allow said second articulation joint means to move along said rail to adjust said spar on a middle plane of the floating body.

4. The paddle device according to claim 1, further comprising a spring attached to said spar and the floating body.

5. The paddle device according to claim 1, wherein one of said spar, and said paddle is arcuate.

6. The paddle device according to claim 1, further comprising at least one guy rope having a first end fixed to said spar, and a second portion fixed to the floating body, wherein a length of said guy rope is adjustable in order to adjust a position of said spar.

7. The paddle device according to claim 6, wherein said second portion of said guy rope is fixed to the floating body by way of a clamp, said clamp being configured to adjust a length of said guy rope from said clamp to said first end.

8. The paddle device according to claim 6, wherein said guy rope is a pair of guy ropes.

9. The paddle device according to claim 1, wherein said spar is one of a telescopic pole, and a plurality of interconnectable spar units.

10. The paddle device according to claim 1, wherein second articulation joint means further comprises a linkage connecting a base plate fixed to the floating body in an articulated manner to a linkage plate, by which said spar is supported.

11. The paddle device according to claim 10, wherein said spar is mounted on said linkage plate by way of a pivoting linkage having a pivoting axis, said pivoting axis being positioned in a central plane of the floating body and an axis of said pivoting linkage extending between said base plate and said linkage plate transversely to the latter.

12. The paddle device according to claim 11, wherein said linkage plate further comprises a bracket which carries said pivoting linkage, said bracket is configured to pivotably receive an end of said spar.

13. The paddle device according to claim 11, wherein said bracket further comprises a pair of stop members configured to restrict a lateral pivoting of said spar, wherein said pivoting linkage is located between said stop members.

14. The paddle device according to claim 10, wherein said second articulation joint means further comprises a locking device for blocking or limiting a pivotability of said linkage plate.

15. The paddle device according to claim 1, wherein said means for limiting the pivotability of said spar is configured to provide a predetermined elasticity.

16. The paddle device according to claim 1, wherein the floating body is selected from the group consisting of a water vehicle, paddle board, a surfboard, a canoe, a kayak, and a boat.

* * * * *